US008235510B2

(12) United States Patent
Lu et al.

(10) Patent No.: US 8,235,510 B2
(45) Date of Patent: Aug. 7, 2012

(54) INK CARTRIDGE APPARATUS FOR CONTINUOUSLY SUPPLYING INK

(75) Inventors: Yi-Ching Lu, Hsinchu (TW); Ming-Chung Peng, Hsinchu (TW); Yun-Hsuan Chen, Hsinchu (TW)

(73) Assignee: Jetbest Corporation, Hsinchu (TW)

( * ) Notice: Subject to any disclaimer, the term of this patent is extended or adjusted under 35 U.S.C. 154(b) by 367 days.

(21) Appl. No.: 12/688,004

(22) Filed: Jan. 15, 2010

(65) Prior Publication Data

US 2011/0141210 A1 Jun. 16, 2011

(30) Foreign Application Priority Data

Dec. 15, 2009 (TW) ..... 98142859 A

(51) Int. Cl.
*B41J 2/175* (2006.01)

(52) U.S. Cl. ..... 347/85; 347/87

(58) Field of Classification Search ..... 347/19, 347/85, 86, 87
See application file for complete search history.

(56) References Cited

U.S. PATENT DOCUMENTS

| | | | | |
|---|---|---|---|---|
| 6,325,496 | B1 * | 12/2001 | Kageyama et al. | 347/85 |
| 6,347,864 | B1 * | 2/2002 | Silverbrook et al. | 347/85 |
| 6,820,973 | B2 * | 11/2004 | Ujita | 347/85 |
| 7,004,574 | B2 * | 2/2006 | Neese et al. | 347/85 |
| 7,083,272 | B2 * | 8/2006 | Silverbrook | 347/85 |
| 7,128,407 | B2 * | 10/2006 | Inoue et al. | 347/85 |
| 7,241,000 | B2 * | 7/2007 | Hirota et al. | 347/85 |

* cited by examiner

*Primary Examiner* — Anh T. N. Vo
(74) *Attorney, Agent, or Firm* — Rabin & Berdo, P.C.

(57) ABSTRACT

An ink cartridge apparatus for continuously supplying ink is provided, including a connection device, an exposed chip socket and a filtering device on an ink cartridge main body. The connection device is for connecting to an ink bottle and the filtering device is for filtering the impurity from the ink flowing from the ink bottle into ink cartridge main body. The exposed chip socket is for the user to replace the chip more conveniently. With the ink supply mechanism of ink bottle into ink cartridge main body, the ink cartridge main body can maintain good ink quality and when the threshold set by the chip is exceeded, the replacement of the chip can be done without removing the entire ink cartridge from the printer so as to achieve the object of continuously supplying ink.

7 Claims, 5 Drawing Sheets

INK CARTRIDGE APPARATUS FOR CONTINUOUSLY SUPPLYING INK

FIELD OF THE INVENTION

The present invention generally relates to an ink cartridge apparatus for inkjet printer or electronic inkjet devices.

BACKGROUND OF THE INVENTION

Inkjet technology has been widely for many years. As the inkjet related devices become popular, the consumption of ink cartridges also increases. The problem related to disposable ink cartridge, such as environment pollution and recycling issue, also gains attention.

In the conventional design of ink cartridge, the ink cartridge is rendered useless and must be disposed when the cartridge is unable to supply ink to the printer, even though there is some residual ink remaining in the cartridge, leading to pollution and waste. To solve this problem, a refillable ink cartridge is developed so that the ink cartridge can be refilled with ink through a funnel. However, the refilling requires extra caution as it is prone to spill and overflow. Another disadvantage is when refilling, the ink cartridge must be removed from the printer and the printing is suspended.

In addition, as the ink may contain some impurity. If the ink cartridge does not include a filtering structure, the impurity will enter the inkjet system with the ink, leading to the blockage of the injection piece. To solve the above problems, an ink cartridge apparatus for continuously supply ink is devised.

SUMMARY OF THE INVENTION

The primary object of the present invention is to provide an ink cartridge apparatus for continuously supplying ink, so as to reduce the number of times to remove an ink cartridge from the printer, as well as, able to continuously supply ink without removing ink cartridge from the printer.

Another object of the present invention is to provide an ink apparatus solving the impurity blockage problem in conventional ink cartridge without filtering structure.

To achieve the above objects, the present invention provides an ink cartridge apparatus, including a connection device, exposed chip socket and a filtering device on the main body of the ink cartridge. The connection device is for connecting a supplement ink bottle for injecting ink into the main body of the ink cartridge. The exposed chip socket is for plugging in or replacing a chip. With the above two features, the number of times to remove the ink cartridge from the printer. The filtering device is for filtering the impurity from the ink to maintain the ink quality so that the ink cartridge apparatus of the present invention can continuously supply ink without removing from the printer for refilling.

The technique for continuously supplying ink of the present invention is to use the connection device to connect the ink bottle. The main body of the ink cartridge includes an air-expelling hose and an air hole so that the ink in the ink bottle can be continuously injected into the ink cartridge main body through the connection device. As the ink is injected into the ink cartridge, the air in the ink cartridge main body is expelled from the air-expelling hose to the air hole and then to the outside. Through this cyclic convection, the continuous supply of ink is achieved.

To maintain the ink quality, the present invention includes a filtering device inside the ink cartridge main body. The filtering device includes a filtering mesh. The ink from the connection device will pass through the filtering mesh before entering the lower level of the ink cartridge main body, and finally to the inkjet system through the injection head. The ink cartridge main body includes an ink outlet for connecting injection head. The location of the ink outlet is designed to be higher than the bottom of the cavity of the ink cartridge so that the impurity can settle at the bottom of the cavity as the second filtering. This will prevent the blockage of the injection head by the impurity in ink. Through the above two phases of filtering, the ink quality can be maintained.

The foregoing and other objects, features, aspects and advantages of the present invention will become better understood from a careful reading of a detailed description provided herein below with appropriate reference to the accompanying drawings.

BRIEF DESCRIPTION OF THE DRAWINGS

The present invention can be understood in more detail by reading the subsequent detailed description in conjunction with the examples and references made to the accompanying drawings, wherein.

DETAILED DESCRIPTION OF THE PREFERRED EMBODIMENTS

Figure 1:
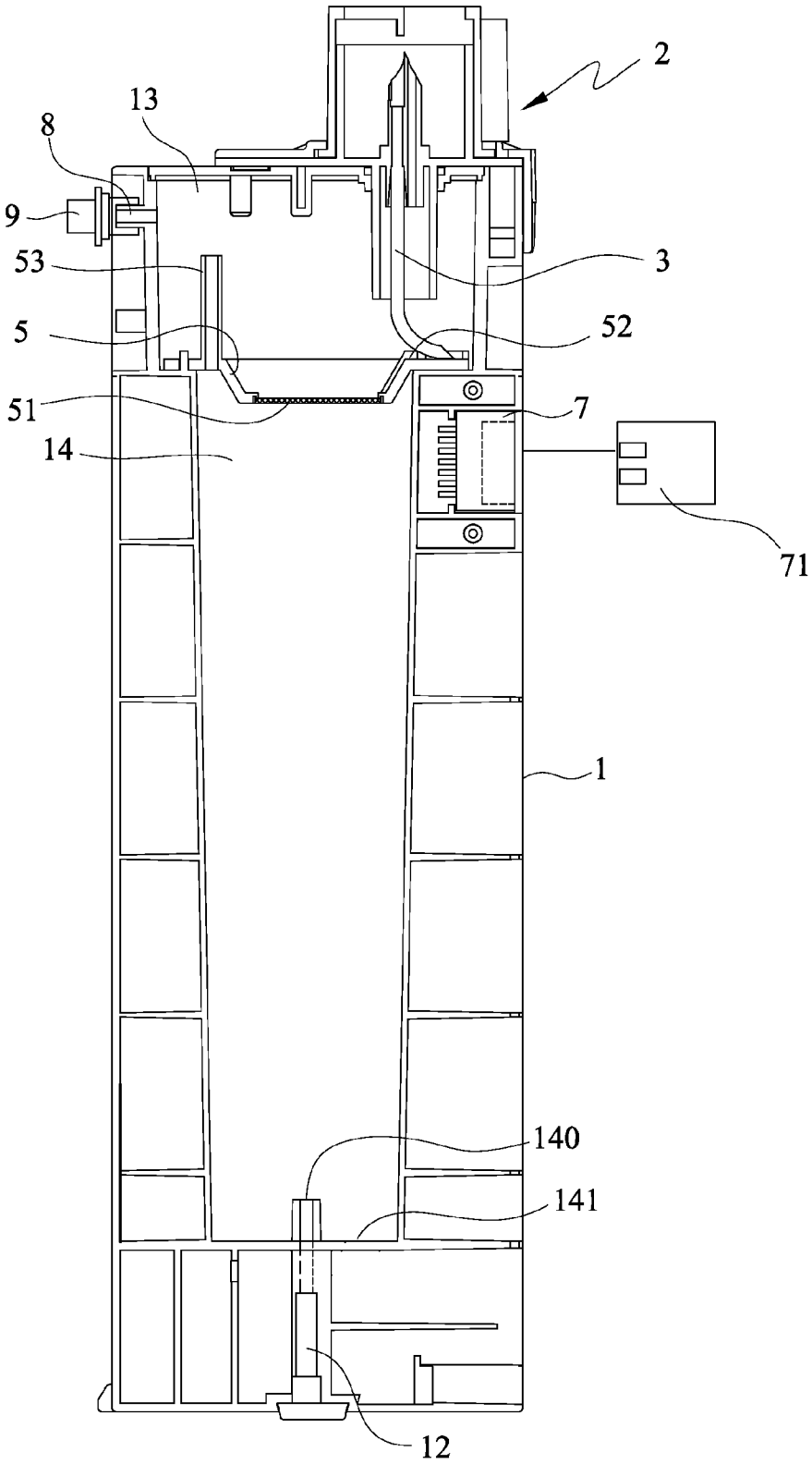
FIG. 1 shows a cross-sectional view of the ink cartridge apparatus for continuous supplying ink according to the present invention.
Figure 2:
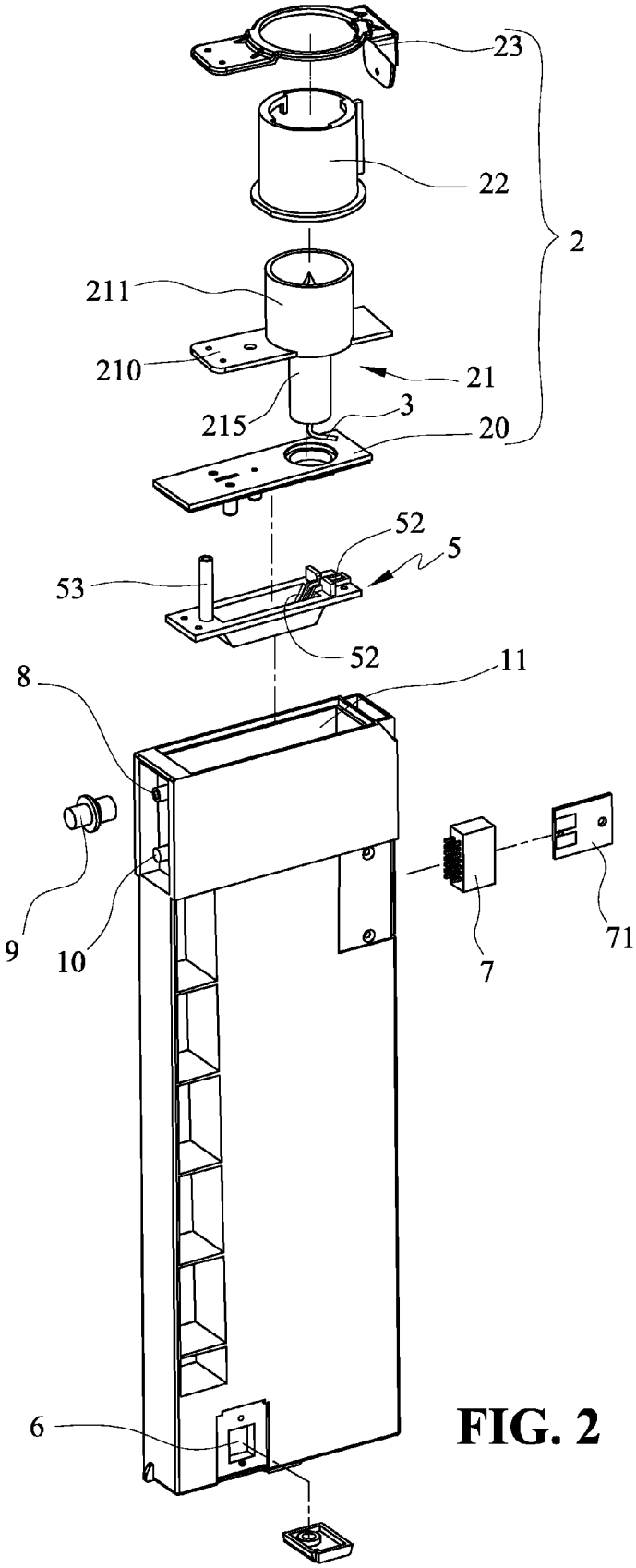
FIG. 2 shows an exploded view of the ink cartridge apparatus for continuous supplying ink according to the present invention.

FIG. 1 and FIG. 2 respectively show a cross-sectional and exploded view of the ink cartridge apparatus for continuously supplying ink according to the present invention. Ink cartridge main body 1 includes a connection device 2, a filtering device 5 and an exposed chip socket 7.

Connection device 2 is installed on ink cartridge main body 1 and for providing connection interface between ink bottle (not shown) and ink cartridge main body 1.

As shown in FIGS. 1 & 2, in the preferred embodiment of the present invention, ink cartridge main body 1 is a container with cavity, and can be made of any suitable material. The top of ink cartridge main body 1 includes a ink inlet 11 for ink injection. Filtering device 5 is included inside the cavity to divide the cavity into an upper cavity 13 and a lower cavity 14. The preferred shape of filtering device 5 is a trapezoid trench with equal heights on both sides and concave in the middle. A filtering mesh 51 is placed in the concave middle part so that the ink will pass from upper cavity 13 through filtering mesh 51 to lower cavity 14. Filtering device 5 forms a guiding trench 52 between a height part and the concave part to guide the ink through filtering mesh 51. At the location close to the bottom of ink cartridge main body is an ink head 12. Inside of lower cavity 14 is an ink outlet 140 connected to ink head 12. Ink outlet 140 must be higher than bottom 141 of cavity. Ink cartridge main body 1 is installed in a printer or inkjet system of other inkjet device. With ink head 12, the ink stored in the cavity of ink cartridge main body 1 can be transported to the printer or inkjet system.

Furthermore, at the location of bottom of ink cartridge main body 1 near ink head 12, a chip control unit 6 is located. Chip control unit 6 has related interface for electrical connection to the printer or other inkjet system for controlling ink supply. To avoid the waste of replacing ink cartridge main body 1, the present invention includes an exposed chip socket on the side or other convenient location of ink cartridge main body 1 for the user to plug in a chip 71. After ink cartridge main body 1 is installed in the printer, a part of ink cartridge main body 1 is exposed. The exposed chip socket 7 must be on the exposed part of ink cartridge main body 1. Exposed chip socket 7 and chip control unit 6 are electrically connected so that chip 71 is controlled by chip control unit 6. When the times of printing exceeds the threshold, chip 71 can be replaced easily.

Figure 3:
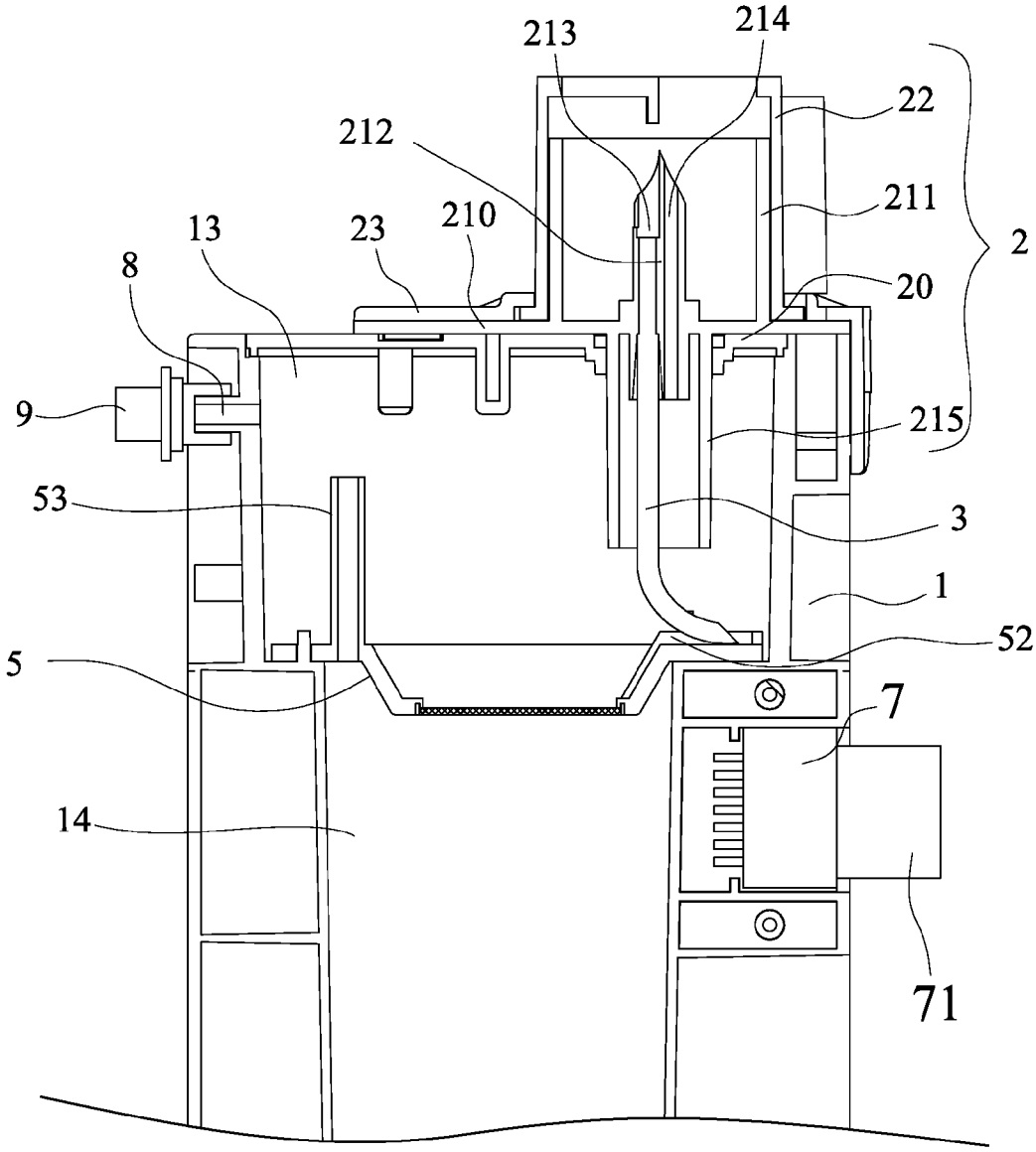
FIG. 3 shows a partial detailed view of the assembly of elements of the ink cartridge apparatus for continuous supplying ink according to the present invention.

Refer to FIG. 2 and FIG. 3. Connection device 2 is attacked to ink cartridge main body 1 for interfacing ink bottle and ink cartridge main body 1. Connection device 2 can be of various embodiments. The following describes a preferred embodiment. Connection device 2 includes a substrate 20, a connection base 21, a tube base 22 and a fixed base 23, where, using the center of connection base 21 as reference, the upper part includes a tube body 211 and the lower part includes a liquid-gas interface tube 215. A fixed board 210 is located between tube body 211 and liquid-gas interface tube 215. Connection base 21 further includes a center column 212 with axis extending inside tube body 211 and liquid-gas interface tube 215. The lower end of liquid-gas interface tube 215 is lower than the lower end of center column 212. Center column 212 further includes an ink flow channel 213 and an air flow channel 214 connecting its two ends. Preferably, the upper end of center column 212 is a needle shape so as to penetrate the ink bottle. Connection base 21 is to let the lower end of center column 212 enter the cavity from ink inlet 11 of ink cartridge main body 1. Tube base 22 and fixed base 23 are for attaching to connection base 21 for providing connection to ink bottle. In assembly, substrate 20 is engaged to, in the order of, connection base 21, tube base 22 and fixed base 23, and then a fixed element is used to fasten substrate 20 to the top surface of ink cartridge main body 1. After assembly, the lower ends of liquid-gas interface tube 215 and center column 212 are both inside upper cavity 13 of ink cartridge main body 1. The lower ends of ink flow channel 213 and air flow channel 214 are of the same height, therefore, an extension tube 3 of non-specific length can be connected to the lower end of ink flow channel 213 so that the lower end of extension tube 3 is lower than the lower end of air flow channel 214. The lower end of extension tube 3 is lower than the lower end of liquid-air interface tube 215, and the lower end of extension tube 3 can be fastened to the source end of guiding trench 52 of filtering device 5.

Furthermore, the other higher end of filtering device 5 includes an air-expelling tube 53, located inside upper cavity 13 for connecting upper cavity 13 and lower cavity 14. The air hole at the top of air-expelling tube 53 is higher than the highest location of the liquid surface inside upper cavity 13. An air hole 8 can be included in ink cartridge main body 1 for connecting outside and upper cavity 13. When stopping supplying ink, a cap cover 9 can be used to cover air hole 8. Conversely, cap cover 9 can be removed to start supplying ink and the cap cover can be sheathed on a column element 10 next to air hole 8 to prevent misplacement of cap cover. Air hole 8 and air-expelling tube 53 can be connected or located in opposite positions.

Figure 4:
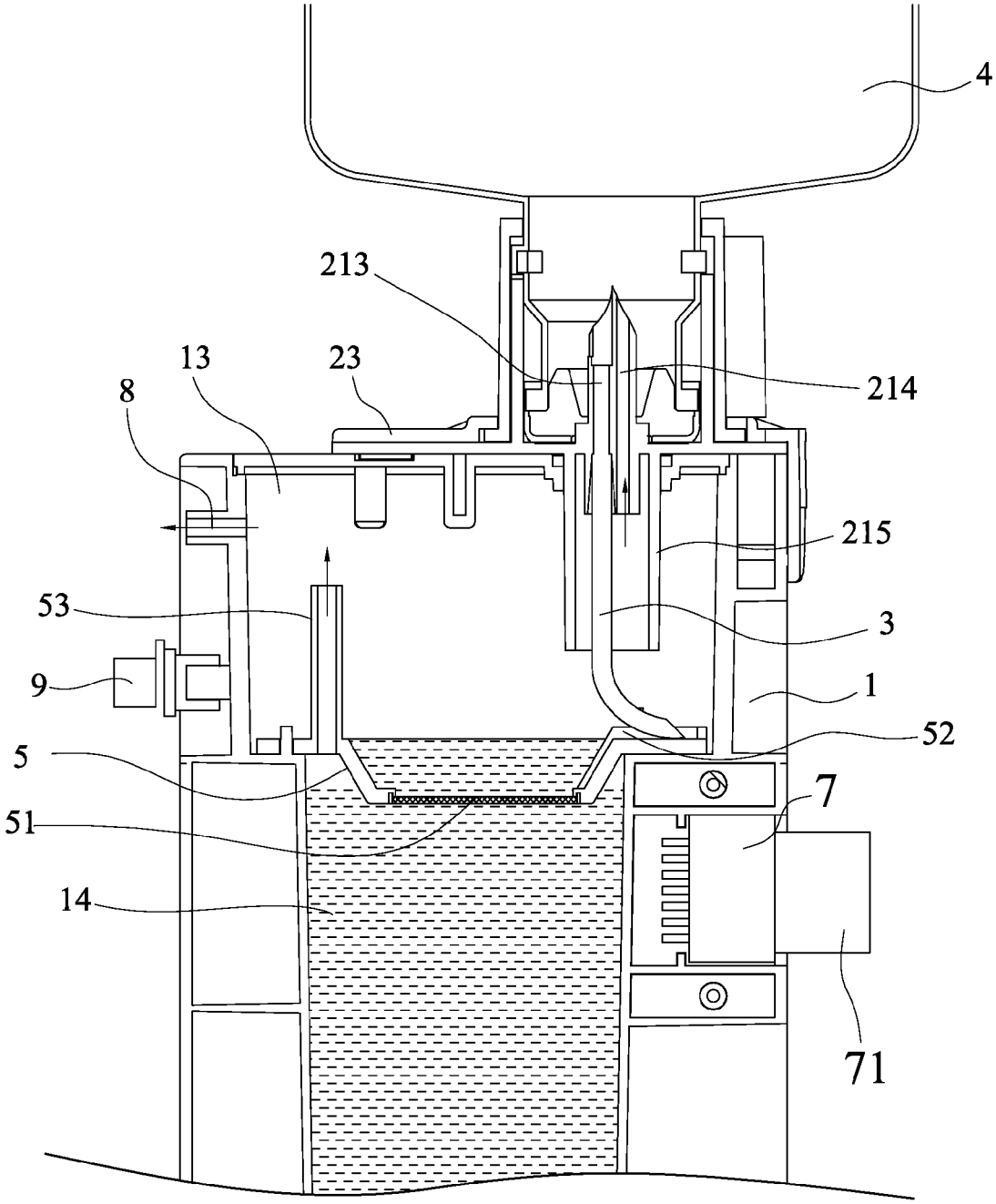
FIG. 4 shows a partially enlarged view of FIG. 3, in the state of the ink level inside the cavity of ink cartridge main body lower than the lower end of liquid-air interface tube.
Figure 5:
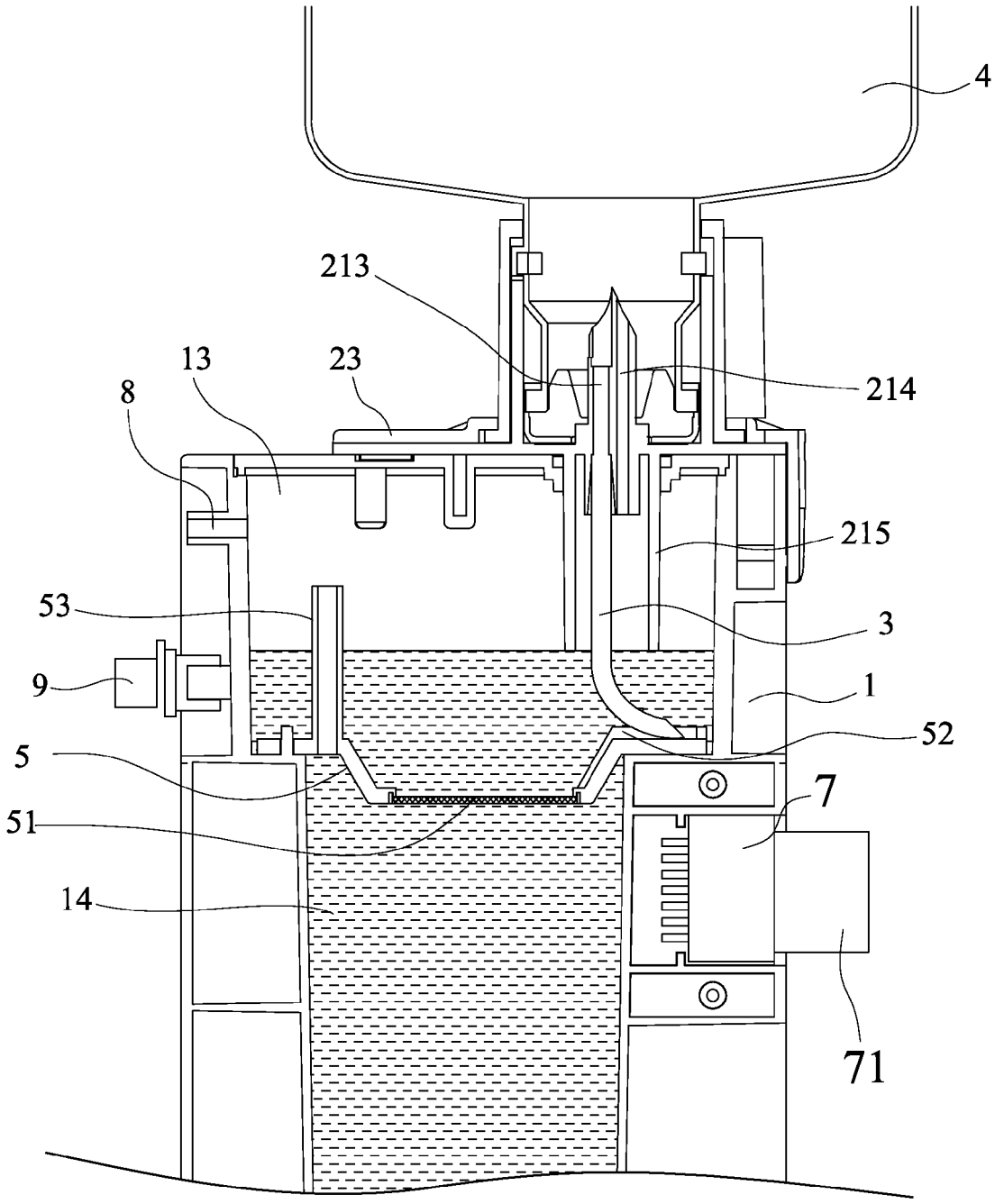
FIG. 5 shows a schematic view of the state when the ink level inside the cavity of ink cartridge main body touches the lower end of liquid-air interface tube to seal the liquid-air interface tube.

Refer to FIG. 4 and FIG. 5, where FIG. 4 and FIG. 5 show the operating state of the ink cartridge apparatus of the present invention. In FIG. 4, the ink inside the cavity of ink cartridge main body 1 is reduced to be lower than the lower end of liquid-air interface tube 215. At this point, the ink inside ink bottle 4 will flow through ink flow channel 213 and extension tube 3 into ink cartridge main body 1, and then is guided by guiding trench 52 of filtering device 5, through filtering mesh 51 of filtering device 5 to filter out impurity, entering lower cavity 14, and finally through ink outlet 140 and ink head 12 to inkjet system (not shown). Because ink outlet 140 is higher than the bottom 141 of lower cavity 14, the settling effect of impurity of the ink at the bottom 141 of lower cavity can be considered as the second phase of filtering. When injecting ink, the air in the cavity is expelled, partly through air flow channel 214 to ink bottle 4 to inject the ink inside ink bottle 4 into ink cartridge main body 1, and partly through air-expelling tube 53 and air hole 8 to the outside. Through this type of cyclic convection loop, the ink can be continuously injected from ink bottle 4 into ink cartridge main body 1 and then to inkjet system. Until the ink level in the cavity of ink cartridge main body 1 rises to touch the lower end of liquid-gas interface tube 215, the lower end is closed (as shown in FIG. 5) and the air inside the cavity of ink cartridge main body 1 can no longer flow through air flow channel 214 to ink bottle 4 and the convection stops. At this point, the ink inside ink bottle 4 stops supplying to ink cartridge main body 1. In other words, even when the ink inside the cavity of ink cartridge main body 1 is used a little, the lowering of the ink level will prompt ink bottle 4 to automatically supply ink to ink cartridge main body 1. When chip 71 counts the number of printing times exceeds a threshold, the ink cartridge will stop supplying ink. As the chip socket is exposed, the replacement of a new chip is convenient, and the ink cartridge can resume ink supply in a short period of break to maintain the ink supply mechanism of ink bottle 4.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. An ink cartridge apparatus for continuously supplying ink, comprising:

an ink cartridge main body having a cavity for ink and an ink outlet in communication with said cavity; and a connection device, disposed on said ink cartridge main body, for connecting to an ink bottle to allow the ink to be injected into said cavity, wherein said ink cartridge main body includes a filtering device that has a filtering mesh dividing said cavity into an upper cavity and a lower cavity, such that the ink flows through said filtering mesh from said upper cavity into said lower cavity, and an air-expelling tube connecting said upper cavity and said lower cavity, an air hole communicating an outside of the ink cartridge main body to said upper cavity, thereby to allow air to enter said upper cavity therethrough, and an exposed chip socket for accommodating a chip to be plugged therein.

2. The ink cartridge apparatus as claimed in claim 1, wherein a top opening of said air-expelling tube is higher than a top of a liquid level inside said upper cavity.

3. The ink cartridge apparatus as claimed in claim 1, wherein said filtering device is shaped as a trapezoid trench with equal heights on both ends thereof and a concave middle part, and said filtering mesh is located at said concave middle part.

4. The ink cartridge apparatus as claimed in claim 1, wherein said filtering device further comprises a guiding trench to guide the ink through said filtering mesh when the ink is injected into said cavity.

5. The ink cartridge apparatus as claimed in claim 1, wherein said ink outlet is located inside said lower cavity, and a top opening of said ink outlet is higher than a bottom of said lower cavity so that said lower cavity facilitates settling of impurity of the ink at said bottom.

6. The ink cartridge apparatus as claimed in claim 1, wherein when said ink cartridge main body is installed in a printer, a part of said ink cartridge main body is exposed to an outside of said printer, and said exposed chip socket is located on said exposed part of said ink cartridge main body.

7. The ink cartridge apparatus as claimed in claim 1, wherein the low cavity is configured to communicate with the outside via the air hole and the air-expelling tube.

* * * * *